US006776641B2

(12) United States Patent
Hachuda

(10) Patent No.: US 6,776,641 B2
(45) Date of Patent: Aug. 17, 2004

(54) SOCKET FOR ELECTRICAL PARTS

(75) Inventor: Osamu Hachuda, Kawaguchi (JP)

(73) Assignee: Enplas Corporation, Kawaguchi (JP)

( * ) Notice: Subject to any disclaimer, the term of this patent is extended or adjusted under 35 U.S.C. 154(b) by 0 days.

(21) Appl. No.: 10/407,975

(22) Filed: Apr. 9, 2003

(65) Prior Publication Data

US 2003/0190831 A1 Oct. 9, 2003

(30) Foreign Application Priority Data

Apr. 9, 2002 (JP) ..... 2002-106409

(51) Int. Cl.[7] ..... H01R 13/62
(52) U.S. Cl. ..... 439/331; 439/206
(58) Field of Search ..... 439/331, 526, 439/330, 73, 70, 266, 525, 268, 71, 206

(56) References Cited

U.S. PATENT DOCUMENTS 5,320,550 A * 6/1994 Uratsuji et al. ..... 439/266
5,493,237 A * 2/1996 Volz et al. ..... 324/754
6,106,319 A * 8/2000 Fukunaga et al. ..... 439/342
6,371,783 B1 * 4/2002 Ohashi et al. ..... 439/268
6,383,002 B1 * 5/2002 Ohashi ..... 439/259

* cited by examiner

*Primary Examiner*—P. Austin Bradley
*Assistant Examiner*—Edwin A. Leon
(74) *Attorney, Agent, or Firm*—Staas & Halsey LLP

(57) ABSTRACT

A socket for an electrical part comprises: a socket body having an electrical part accommodation portion; a contact pin to be contacted to or separated from a terminal of the electrical part; an open/close member provided for the socket body for pressing the electrical part accommodated on the accommodation portion; and an operation member disposed to be vertically movable so as to open or close the open/close member. The open/close member includes a pressing member such as heat sink for pressing the electrical part and a link mechanism supporting the pressing member to be openable, and the link mechanism comprises a first link disposed to be rotatable to the pressing member and the socket body and a second link disposed to be rotatable to the first link and the operation member.

11 Claims, 13 Drawing Sheets

SOCKET FOR ELECTRICAL PARTS

BACKGROUND OF THE INVENTION

1. Field of the Invention

The present inventton relates to a socket for an electrical part for detachably holding and accommodating an electrical part such as a semiconductor device (called as "IC package" hereinlater).

2. Related Art of the Invention

In a known art, there has been provided an IC socket, as "socket for an electrical part" for detachably holding and accommodating an "IC package" as an electrical part.

Such IC socket has a socket body provided with a contact pin which contacts a terminal of the IC package so as to establish an electrical connection and also has an open/close member to be rotatable so that when the open/close member is closed, the IC package accommodated on the socket body is pressed.

This open/close member is urged, by means of twist coil spring, towards a closing direction (i.e., a direction for urging the IC package), and on the contrary, is opened, against the urging force of the twist coil spring, by lowering an operation member which is disposed to the socket body to be vertically movable. According to this manner, the IC package can be accommodated in or taken out from the socket body.

When the IC package is pressed by the open/close member, the terminal of the IC package and the contact pin of the IC socket are contacted at a predetermined pressure.

The open/close member is also provided with a heat sink, and in its contacting state to the IC package, heat of the IC package is radiated.

However, in such conventional structure of the IC socket, the open/close member is urged by the twist coil spring towards the closing direction, the terminal of the IC package is contacted to the contact pin by this urging force, and the open/close member is opened by rotating it against the urging force of the twist coil spring. Accordingly, there is a limit to increasing of the urging force of the twist coil spring in order to ensure a desired contacting pressure, and the increasing of the urging force thereof results in a large force to open the open/close member, thus providing conflicting function or problem and hence being inconvenient.

SUMMARY OF THE INVENTION

An object of the present invention is therefore to substantially eliminate problems or inconveniences encountered in the prior art mentioned above and to provide a socket for an electrical part comprising:

a socket body having an electrical part accommodation portion;

a contact pin provided for the socket body so as to be contacted to or separated from a terminal of the electrical part;

an open/close member provided for the socket body for pressing the electrical part accommodated on the accommodation portion of the socket body; and an operation member disposed for the socket body to be vertically movable so as to open or close the open/close member, the open/close member including a pressing member for pressing the electrical part and a link mechanism for supporting the pressing member to be openable, the link mechanism comprising a first link disposed to be rotatable to the pressing member and the socket body and a second link disposed to be rotatable to the first link and the operation member, wherein when the operation member is moved downward, one end side of the second link is lowered so as to rotate the first link about the socket body side through the second link and to thereby displace the pressing member from a pressing position at which the electrical part is pressed to a retired position at which the electrical part is attached to or detached from the electrical part accommodation portion, and on the other hand, when the operation member is moved upward, one end side of the second link is moved upward so as to rotate the first link about the socket body side and to displace the pressing member to the pressing position from the retired position.

According to the present invention of the aspect mentioned above, when the operation member is moved downward, one end side of the second link is lowered so as to rotate the first link about the socket body side through the second link and thereby to displace the pressing member from a pressing position at which the electrical part is pressed to a retired position at which the electrical part is attached to or detached from the electrical part accommodation portion, so that the depressing force to the operation member for opening the open/close member is made smaller in comparison with a conventional structure because of no need of a force against the urging force of the twist coil spring for ensuring the pressing force of the heat sink.

Furthermore, in the closed state of the open/close member, when a force for opening the open/close member due to the reaction force from the electrical part acts on the open/close member, the second link acts as strut member, without using any twist coil spring as in the conventional structure, to thereby prevent the opening motion of the open/close member, thus ensuring the contacting pressure of the contact portion of the contact pin to the terminal of the electrical part.

In a preferred embodiment of the above aspect, the first link includes a first link outside member and a first link inside member, which are arranged in parallel with a predetermined interval. The second link comprises a pair of side plates disposed to both sides of the pressing member and a coupling bridge portion coupling the side plates.

The pressing member may be a heat sink carrying out heat radiation through abutment against the electrical part.

The socket body may comprise a base portion to which a number of contact pins to be contacted to the terminals of the electrical part are arranged and a floating plate disposed above the base plate to be vertically movable with respect thereto, the floating plate having the electrical part accommodation portion.

The operation member has side portions to which ventilation passages are formed respectively so as to establish air circulation inside and outside thereof.

According to such preferred embodiment, the parallel arrangement of the first link outside and inside members makes it possible to suppress the deformation thereof even if any horizontal force is applied. In addition, in a case where a one-side pressing is applied to the operation member, the inclination of the pressing member can be largely reduced by unifying the first link members disposed both the lateral outside and inside thereof.

The nature and further characteristic features of the present invention will be made more clear from the following descriptions made with reference to the accompanying drawings.

BRIEF DESCRIPTION OF THE DRAWINGS

In the accompanying drawings:

FIG. 12 shows an outside member of a first link according to the described embodiment of the present invention, in which

FIG. 13 shows an inside member of the first link according to the described embodiment of the present invention, in which

FIG. 14 shows a second link according to the described embodiment of the present invention, in which

FIG. 19 shows the IC package, in which

DESCRIPTION OF THE PREFERRED EMBODIMENT

Figure 1:
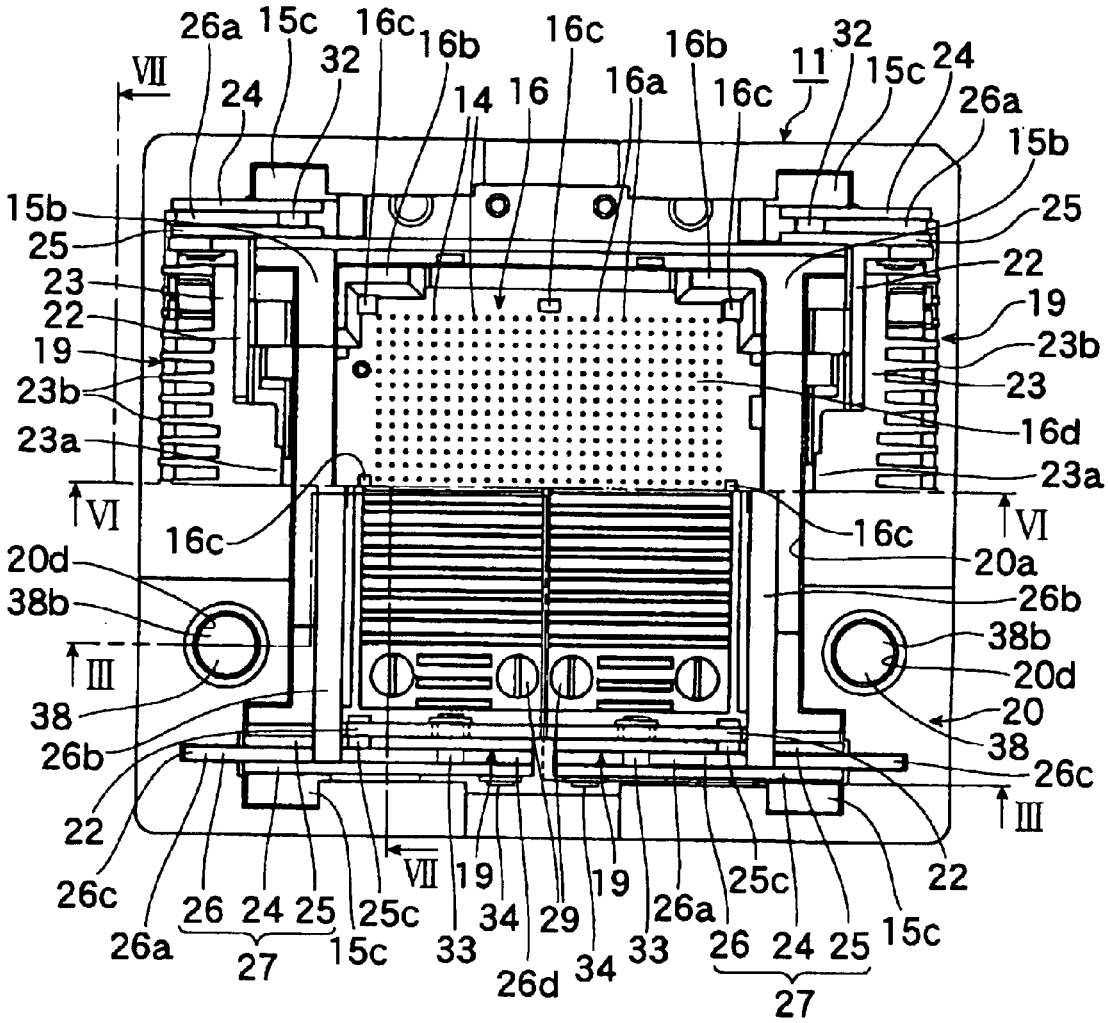
FIG. 1 is a plan view of an IC socket according to one embodiment of the present invention, in which an upper half of a pair of open/close members is opened.

A preferred embodiment of the present invention will be described hereunder with reference to the accompanying drawings of FIGS. 1 to 19. Further, it is first to be noted that terms "right", "left", "upper", "lower" and the like are used herein with reference to the illustrated state on the drawings or in a generally using state of the socket of this kind.

With reference to FIGS. 1 to 19, reference numeral 11 denotes an IC socket as "a socket for an electrical part", which is a socket for establishing an electrical connection between a terminal 12*b* in form of plate of an IC package 12 as "an electrical part" and a printed circuit board, not shown, of a measuring device such as tester, for carrying out a performance test of the IC package 12.

Figure 19A:
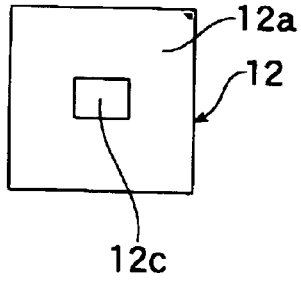
FIG. 19A is a plan view of the IC package.
Figure 19B:
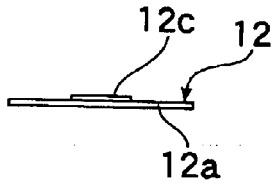
FIG. 19B is a front view thereof and FIG. 19C is a bottom-surface view thereof.
Figure 19C:
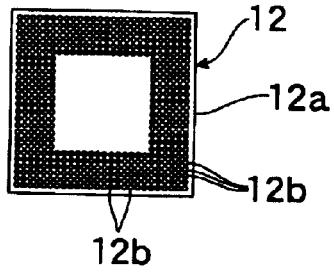

The IC package 12 is so-called an LGA (Land Grid Array) type, such as shown in FIGS. 19A, B, and C, in which terminals 12*b* each in shape of plate are arranged in rows to a lower surface of a square package body 12*a* of the IC package 12. A die 12*c* protruded upward as shown in FIG. 19B is formed to the central portion of the upper surface of the package body 12*a*.

On the other hand, the IC socket 11 has a socket body 13 arranged on a printed circuit board, not shown, and this socket body 13 has a base portion 15 to which a number of contact pins 14 contacting terminals 12*b* of the IC package 12 are disposed and a floating plate 16 disposed on the upper side of the base portion 15.

A pair of open/close members 19 for pressing the IC package 12 are disposed to the socket body 13 to be rotatable, i.e. pivotal, and an operation member 20 in form of square frame is also provided for the socket body 13 to be vertically movable so as to open or close the open/close members 19.

Figure 8:
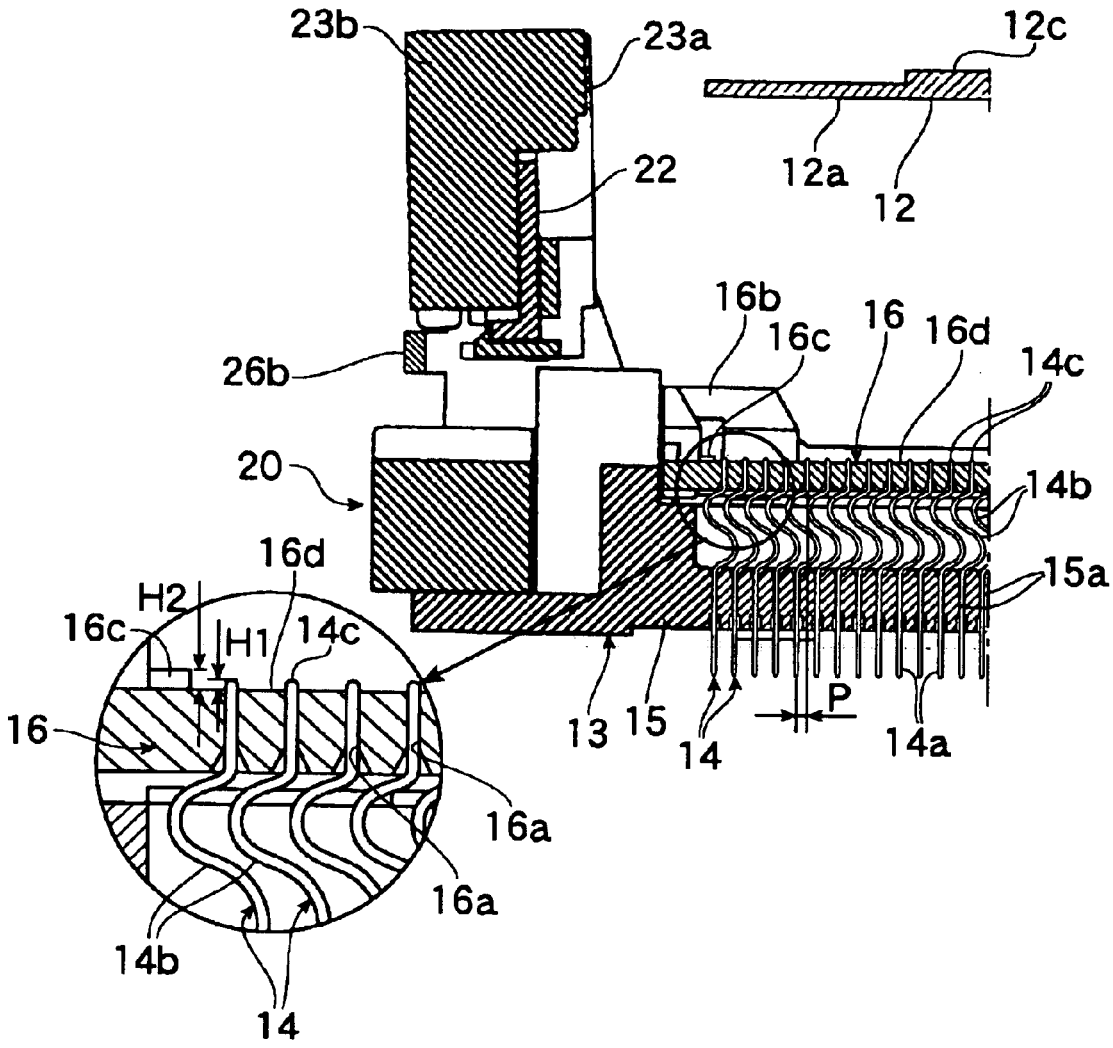
FIG. 8 is a sectional view showing the open/close member which is opened for the explanation of a function of the embodiment of the present invention at the time of the IC package accommodation.
Figure 9:
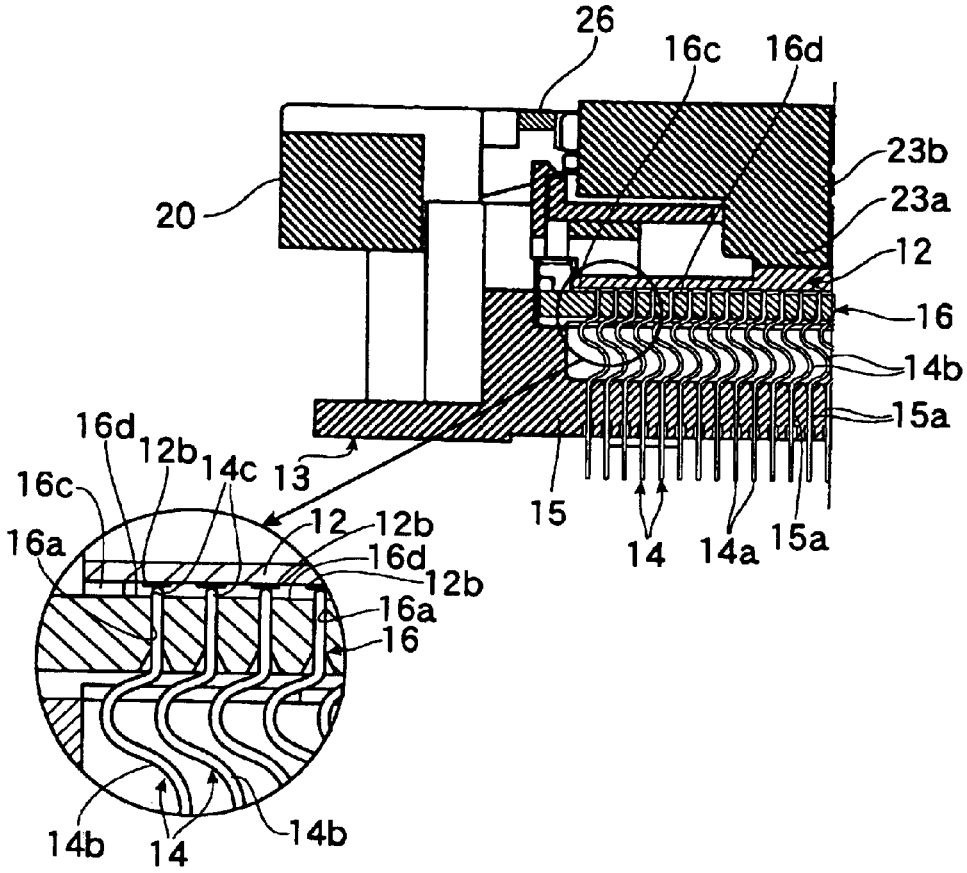
FIG. 9 is a sectional view showing the open/close member which is closed for the explanation of the embodiment of the present invention at the time when the IC package is accommodated.

More in detail, each of the contact pins 14 is formed from a plate member having a springy property and an excellent conductivity as shown in FIGS. 8 and 9. The contact pin 14 is fitted and secured to an press-in hole 15*a* formed to the base portion 15 of the socket body 13, and the contact pin 14 has a lead portion 14*a* which extends downward from the base portion 15 so as to be electrically connected to the printed circuit board. The contact pin 14 is also provided with an elastic (resilient) portion 14*b* formed on the upper side of the lead portion 14*a*. The elastic portion 14*b* has approximately S-shape and elastically deformable property. A contact portion 14*c* is further formed to an upper end portion of the elastic portion 14*b* so as to abut against the IC package terminal 12*b* from the lower side thereof to establish an electrical connection therebetween.

The contact pin 14 is inserted through a through hole 16*a* of the floating plate 16.

This floating plate 16 has a rectangular shape in an outer appearance and has an accommodation surface portion 16*d* on which the IC package 12 is held and accommodated to be vertically movable with respect to the base portion 15 of the socket body 13. The floating plate 16 is urged upward by means of spring 17 (FIG. 7) and is stopped at a top dead center or position by a stopper portion 15*b* (FIG. 5) formed to the base 15 so as to extend upward. The stopper portion 15*b* abuts against the upper surface of a guide portion 16*b* of the floating plate 16.

The guide portion 16*b* is a portion for guiding the IC package 12 at the accommodating operation thereof, the guide portion 16*b* being formed at a portion corresponding to each corner portion of the package body 12*a*. Furthermore, as shown in FIGS. 1, 8 and 9, there are also formed projections 16*c* for mounting the IC package 12 at six positions so as to support the IC package through the abutment against a peripheral edge portion of the package body 12*a*, around the forming area of a number of through holes 16*a* formed in shape of matrix.

The contact pin 14 is disposed throughout the through hole 16*a* of the floating plate 16 so that the contact portion 14*c* projects upward over the through hole 16*a* irrespective of accommodation or non-accommodation of the IC package 12 onto the accommodation surface portion 16*d*. FIG. 8 shows the non-accommodation state of the IC package 12 and FIG. 9 shows the accommodation state thereof.

In the non-accommodation state of the IC package 12, that is, in the top dead center of the floating plate 16, as shown in FIG. 8, a projecting distance H2 of the mount projection 16*c* from the accommodation surface portion 16*d* of the floating plate 16 is made to be larger than a projecting distance H1 of the contact portion 14*c* of the contact pin 14 from the through hole 16*a* of the floating plate 16. Thus, at the top dead center, the contact portion 14*c* of the contact pin 14 does not contact the terminal 12*b* of the IC package 12 in the state that the IC package 12 is mounted on the mount projections 16*c* of the floating plate 16. When the floating plate 16 is depressed downward from the top dead center, the contact portion 14*c* of the contact pin 14 contacts the terminal 12*b* of the IC package 12 as shown in FIG. 9 at a predetermined contacting pressure.

Further, a pair of open/close members 19 are disposed to be rotatable (i.e. pivotal) in both-side openable manner, each of the open/close members 19 has a base plate 22 to which a heat sink 23 as pressing portion or member is formed, which is supported by the socket body 13 through a link mechanism 27 in a manner such that the heat sink 23 is displaced from the pressing position at which it presses the IC package 12 to its retiring or retired position. The link mechanism 27 includes a pair of first link (including first link outside member 24 and a first link inside member 25) and a second link 26 disposed on both sides of the base plate 22, respectively.

More specifically, the heat sink 23 is made from an aluminum die-cast having a good heat conductivity, and the heat sink 23 has one side surface (lower side surface) to which an abutting projection 23*a* is formed so as to abut against the IC package 12 and the other side surface (upper side surface) to which a number of radiation fins 23*b* are formed for effective heat radiation.

Figure 10:
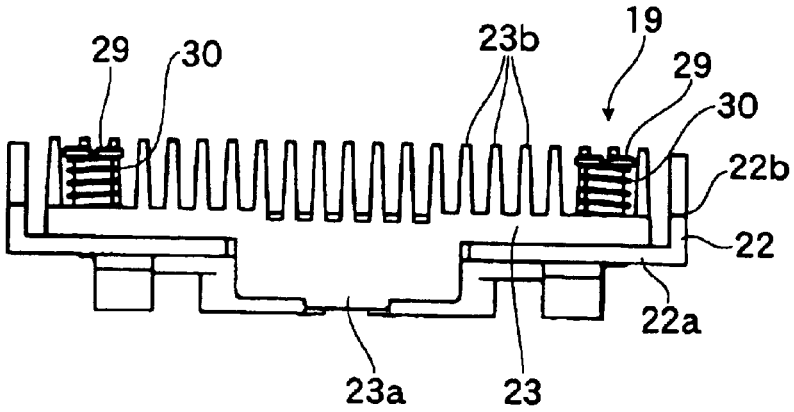
FIG. 10 is a sectional view showing structural relationship between a base plate and a heat sink of the described embodiment of the present invention.
Figure 11:
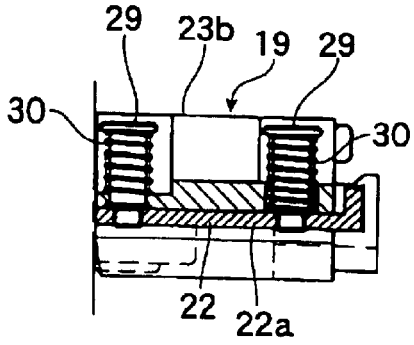
FIG. 11 is a sectional view showing a mounting condition between the base plate and the heat sink.

As shown in FIGS. 1, 10 and 11, the heat sink 23 is mounted to the base plate 22 to be movable in parallel in a perpendicular direction with respect to a plane (flat) surface 22*a* of the base plate 22 under the guidance of four mounting screws 29 screwed with the base plate 22, and the heat sink 23 is urged in a direction abutting the base plate flat surface portion 22*a* by means of coil springs 30 each disposed around the mounting screw 29.

Figure 12A:
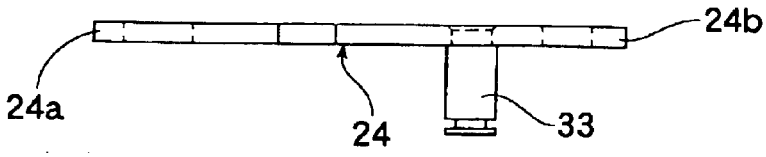
FIG. 12A is a plan view.
Figure 12B:
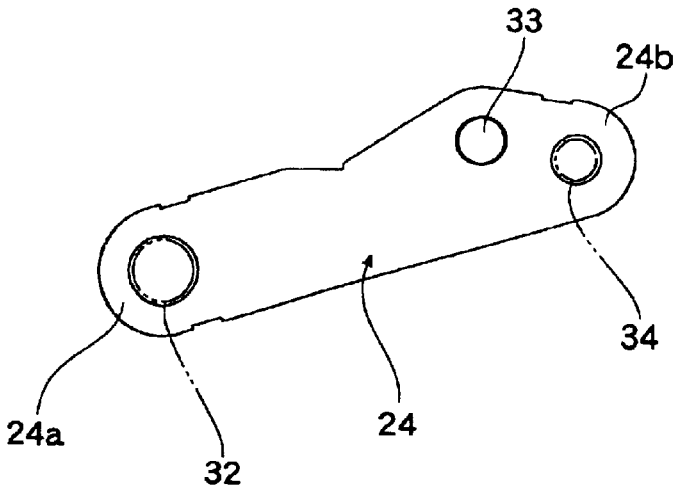
FIG. 12B is a front view and FIG. 12C is a right-side view of FIG. 12B.
Figure 12C:
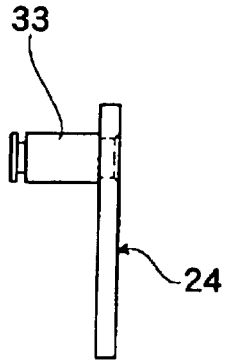
Figure 13A:
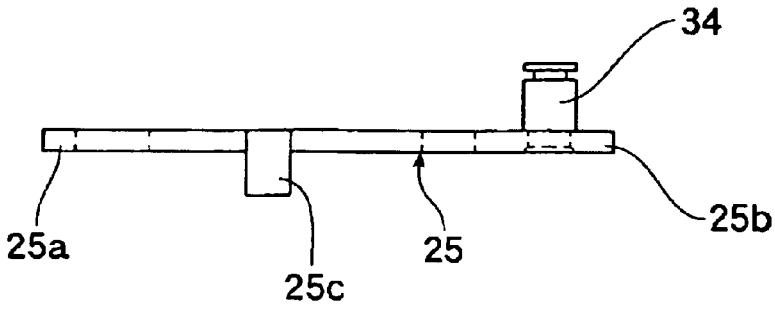
FIG. 13A is a plan view.
Figure 13B:
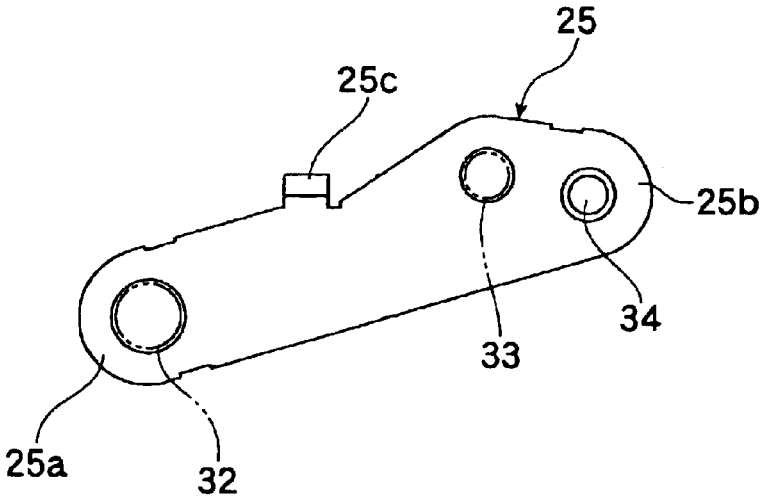
FIG. 13B is a front view and FIG. 13C is a right-side view of FIG. 13B.
Figure 13C:
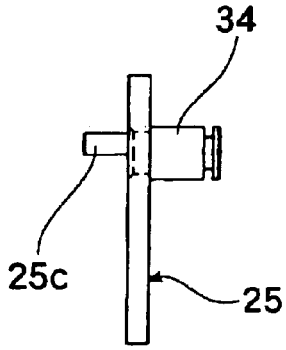

Furthermore, the first link outside member 24 and the first link inside member 25 are formed so as to provide plate shapes as shown in FIG. 12 (12A, 12B, 12C) and FIG. 13 (13A, 13B, 13C), respectively, and as shown, one end portions 24*a* and 25*a* of these members are supported to support post 15*c* projecting from the base portion 15 of the socket body 13 through a support shaft or pin 32 to be vertically rotatable. Further, it is to be noted that the first link outside member 24 and the first link inside member 25 are disposed on both sides of the base plate 22 to be symmetric with each other and only one of them is shown in FIGS. 12 and 13.

The other end portions 24*b* and 25*b* or near of the first link outside member 24 and first link inside member 25 are attached to a perpendicular piece 22*b* of the base plate 22 to be rotatable through a mount shaft 33. Furthermore, the first link inside member 25 is formed with a crocked engaging piece 25*c* to be engageable with a perpendicular piece 22*b* of the base plate 22 as shown in FIG. 1. According to this engagement, the base plate 22 is prevented from being rotated or pivoted in one direction about the mount shaft 33 with respect to the first link outside member 24 and the first link inside member 25.

Figure 14A:
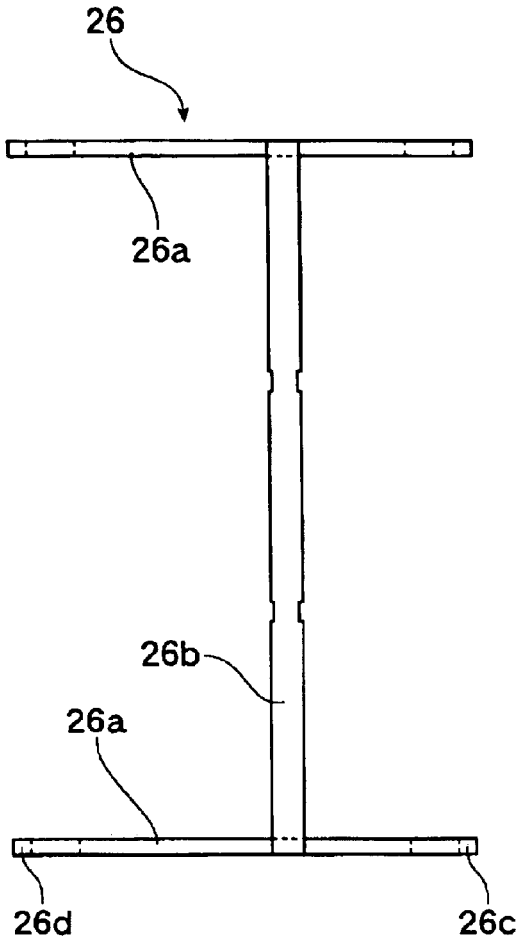
FIG. 14A is a plan view of the second link.
Figure 14B:
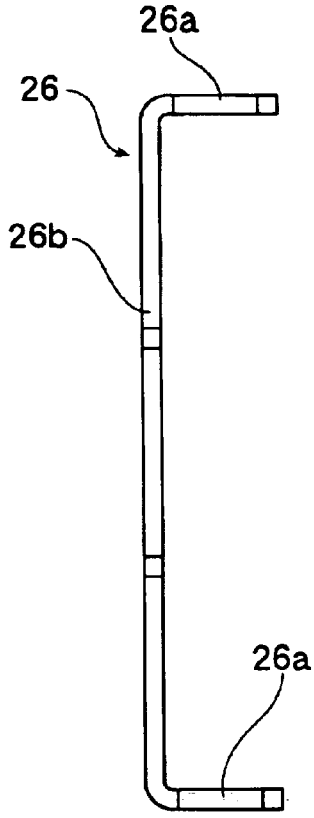
FIG. 14B is a front view thereof and FIG. 14C is a right-side view of FIG. 14A.
Figure 14C:
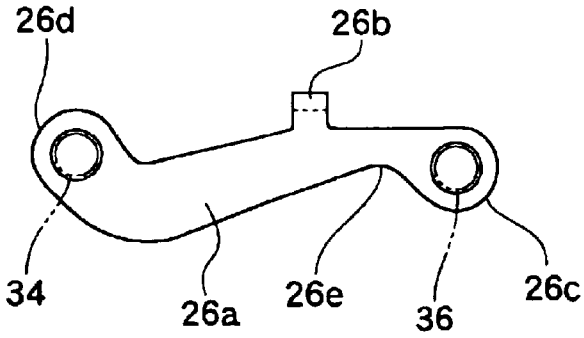

Still furthermore, as shown in FIG. 14 (14A, 14B, 14C), the second link member 26 is provided with a pair of side plate portions 26*a* disposed on both sides of the heat sink 23 and a connection bridge portion 26*b* in form of long scale plate. These side plate portions 26*a* are disposed in a clamped state between the first link outside and inside members 24 and 25 to thereby keep the parallel arrangement of these members 24 and 25 with a predetermined interval.

The one end 26*c* of the side plate portion 26*a* is mounted, to be rotatable, to the operation member 20 through a power point shaft 36, and the other end 26*d* of the side plate portion 26*a* and the other ends 24*b* and 25*b* of the first link outside and inside members 24 and 25 are coupled to be rotatable to each other through the coupling shaft 34.

Figure 5:
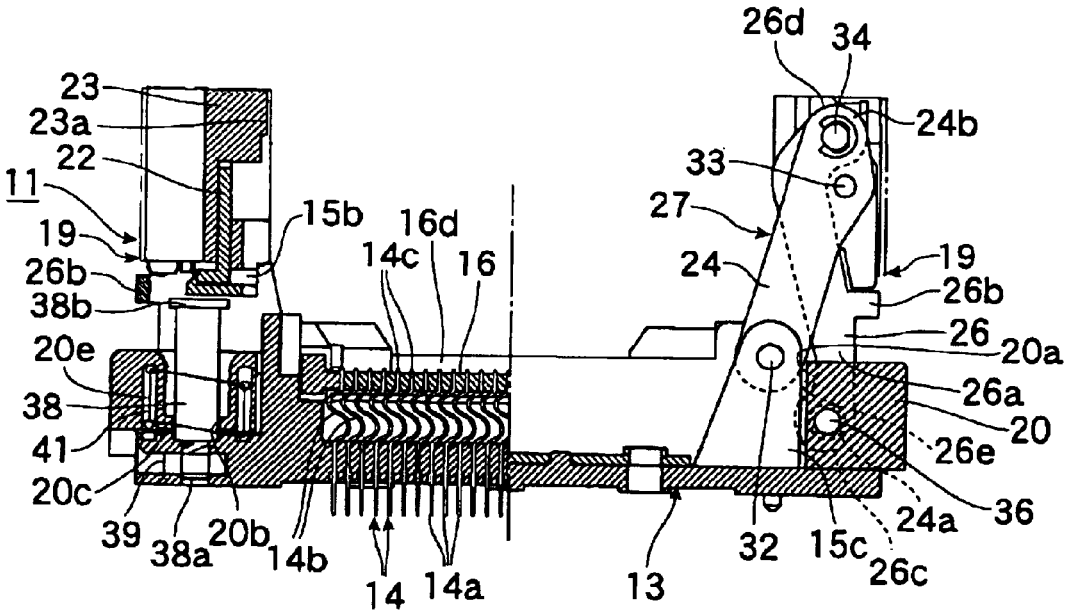
FIG. 5 is a sectional view, corresponding to FIG. 4, showing a state of the operation member moved to the most-downward position.

According to the structure mentioned above, when the operation member 20 is lowered from the top dead center, the position of the power point shaft 36 is lowered and the lower edge recessed portion 26*e* of the side plate portion 26*a* of the second link 26 abuts against the support shaft 32. Then the coupling shaft 34 as point of action is rotated upward with the support shaft being fulcrum of lever, whereby the first link outside member 24 and the first link inside member 25 are rotated upward with the support shaft 32 being the center thereof and the base plate 22 and the heat sink 23 are thereby opened upward as shown in FIG. 5.

Figure 15:
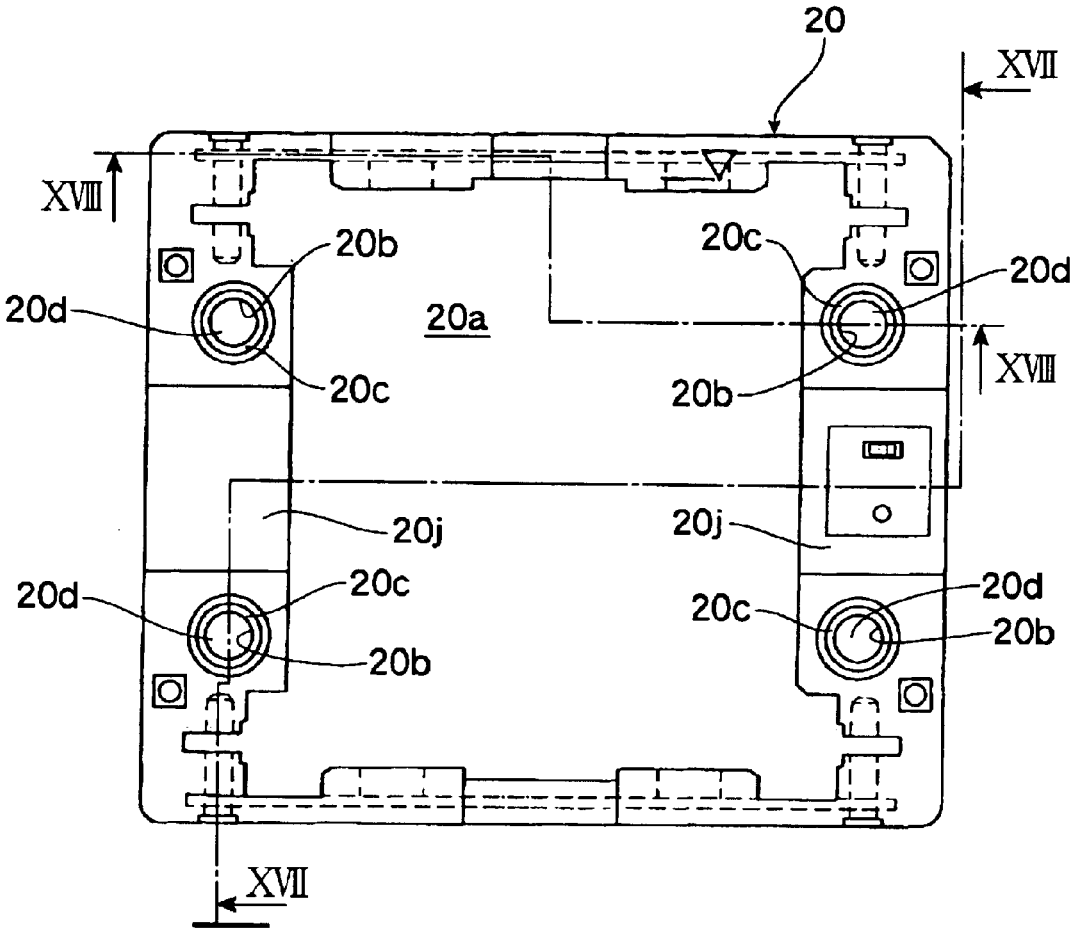
FIG. 15 is a plan view of an operation member of the described embodiment of the present invention.

On the other hand, the operation member 20 has, as shown in FIG. 15, a rectangular frame shape having a large opening 20*a* through which the IC package 12 can be inserted, and the operation member 20 is disposed to be vertically movable with respect to the socket body 13.

Figure 3:
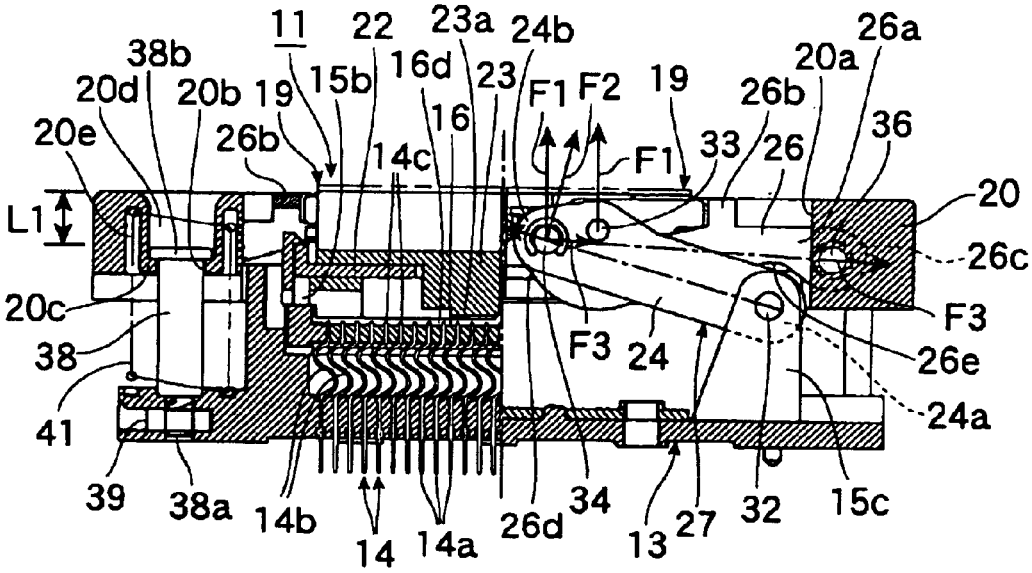
FIG. 3 is a sectional view taken along the line III—III of FIG. 1.

That is, as shown in FIG. 3, the screw portions 38*a* of the four guide pins 38 are screwed and fastened to the nuts 39 provided for the socket body 13, and by inserting these guide pins 38 into the guide holes 20*b* formed to the operation member 20, the operation member 20 is guided by the guide pins 38 to be vertically movable. The operation member 20 is then urged upward by the coil springs 41 disposed around the guide pins 38, respectively, and when moved to the top dead center, the peripheral edge portion 20*c* of the guide hole 20*b* of the operation member 20 abuts against the upper end flanged portion 38*b* of each guide pin 38 to thereby prescribe the upward movement of the operation member 20.

The guide hole 20*b* of the operation member 20 is designed such that it is formed to the bottom surface of its recessed portion 20*d* opened upward for the guide pin 38, and when the operation member 20 is positioned at its top dead center, the upper end flanged portion 38*b* of the guide pin 38 is positioned lower than the upper surface portion of the operation member 20 by a distance L1 as shown in FIG. 3.

Furthermore, an approximately circular ring shape recessed portion 20*c* opened downward for the spring 41 is formed around the recessed portion 20*d* for the guide pin 38 so that the upper end side of the coil spring 41 is fitted into this recessed portion 20*c*. At the top dead center of the operation member 20, the upper end of the coil spring 41 is positioned higher than the upper end flanged portion 38*b* of the guide pin 38 as shown in FIG. 3.

Figure 2:
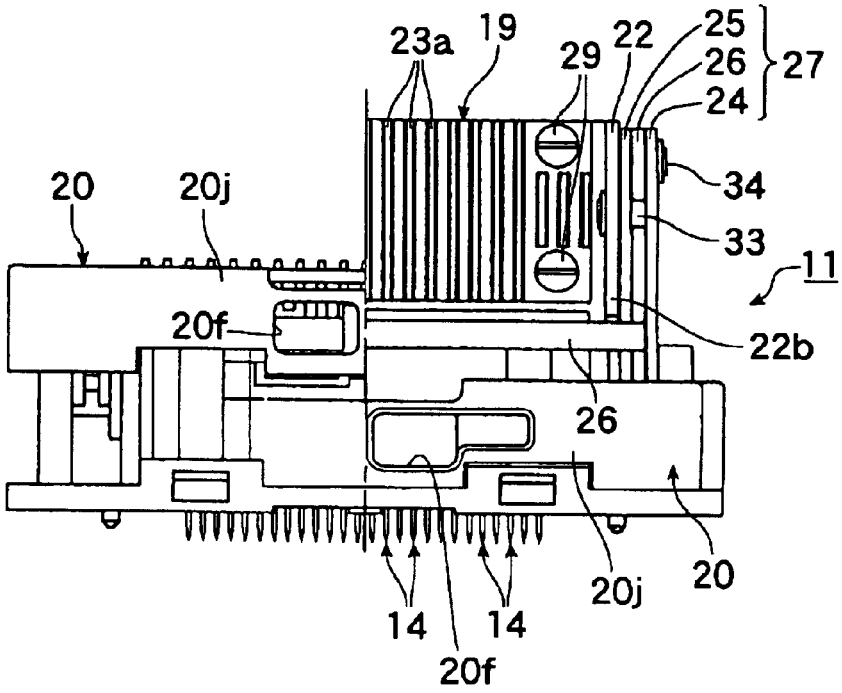
FIG. 2 is a right-side view of the IC socket shown in FIG. 1.
Figure 16:
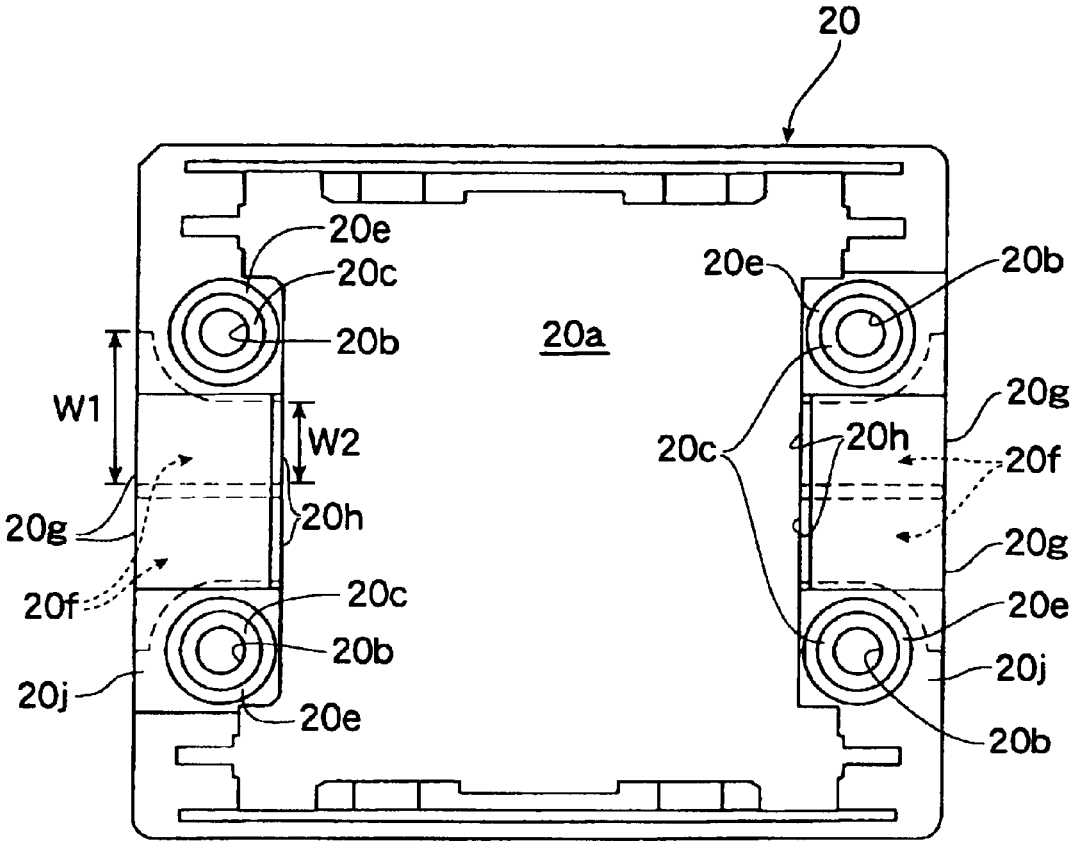
FIG. 16 is a bottom surface view of the operation member.
Figure 17:
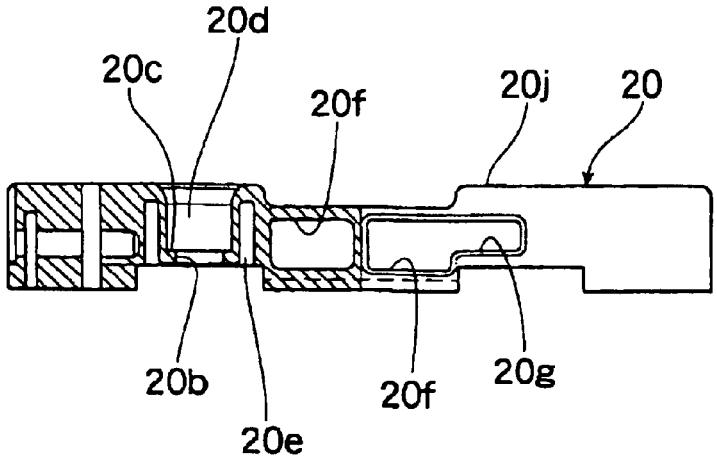
FIG. 17 is a sectional view taken along the line XVII—XVII of FIG. 15.
Figure 18:
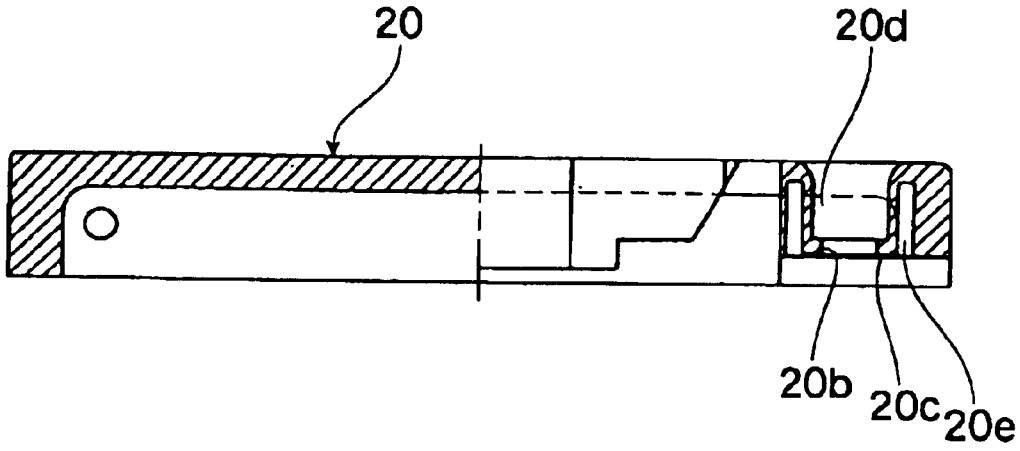
FIG. 18 is a sectional view taken along the line XVIII—XVIII of FIG. 15.

Still furthermore, the operation member 20 is, as shown in FIGS. 2 and 16, provided, at its opposing side portions 20*j*, with two ventilation passages 20*f*, respectively. The paired ventilation passages 20*f* of each side portion 20*j* of the operation member 20 are formed between the paired recessed portions 20*d* for the guide pins 38 in the horizontal direction as viewed in such a manner that an outside opening 20*g* is formed on the outer edge side of the side portion 20*j* and an inside opening 20*h* is formed on the inner edge side of the side portion 20*j*. Each of the outside openings 20*g* has a width W1 wider than a width W2 of each of the inside openings 20*h*.

According to such structure, when the open/close member 19 is in the closed state, outside air invading through the outside openings 20*g* of the ventilation passages 20*f* flows inside the operation member 20 and then towards the frame-shape heat sink 23 disposed inside to thereby be exhausted from the inside towards the outside thereof.

The IC package 12 is held and accommodated in the IC socket 11 of the structure mentioned above according to the following manner.

Figure 4:
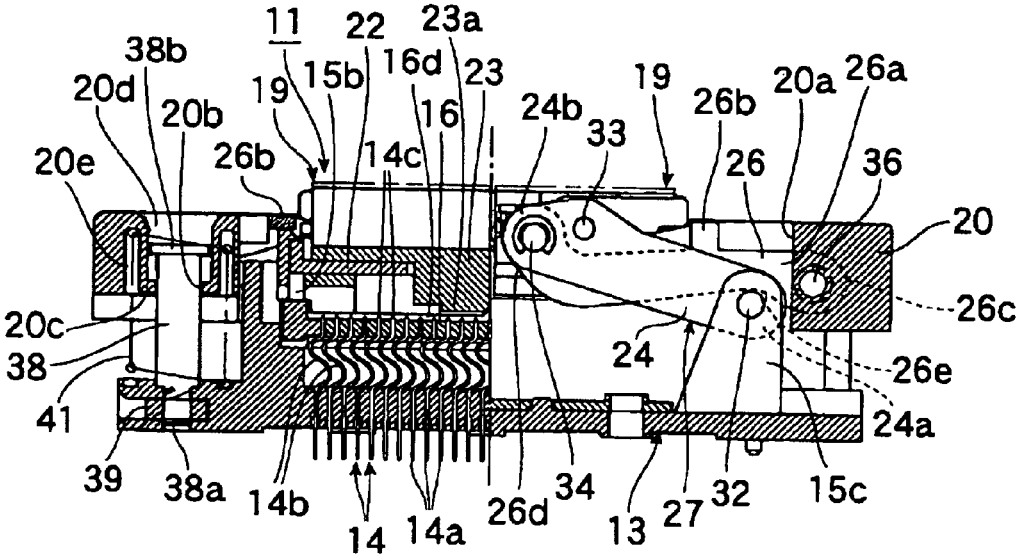
FIG. 4 is a sectional view, corresponding to FIG. 3, showing a state on the way of lowering of an operation member of the IC socket.

First, the operation member 20 is depressed by, for example, an automatic machine, against the urging force of the spring 41. According to this motion, the power point shaft 36 of the operation member 20 is lowered and the second link 26 is rotated downward, and then, the lower end edge recessed portion 26*e* of the second link 26 abuts against the support shaft 32 as shown in FIG. 4.

When the operation member 20 is further depressed from this state, the second link 26 is rotated (pivoted) in accordance with lever's theory about its support shaft 32, the coupling shaft side is moved upward, the first link outside member 24 and the first link inside member 25 are rotated upward about the support shaft 32, and the base plate 22 and the heat sink 23 are lifted upward through the mount shaft 33, thus being opened as shown in the state of FIG. 5.

At this operation, the depressing force to the operation member 20 is a sum of depressing force to the coil spring 41 and the weight of the heat sink 23 and others. Accordingly, there is no need of additional force against the urging force of the twist coil spring for ensuring the depressing force to the heat sink 23, which is required for the conventional structure, thus easily opening the open/close member 19 with a reduced force.

Furthermore, since the base plate 22 and the heat sink 23 are supported to the mount shaft 33 and the engaging piece 25*c* of the first link inside member 25, the base plate 22 and the heat sink 23 can be prevented from being largely rotated or swung about the mount shaft 33.

Figure 6:
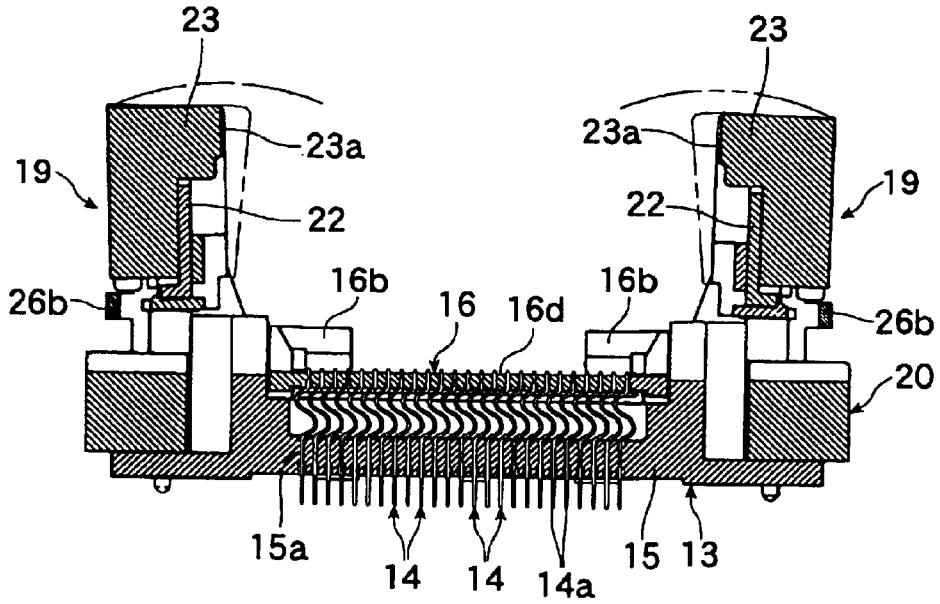
FIG. 6 is a sectional view taken along the line VI—VI of FIG. 1.
Figure 7:
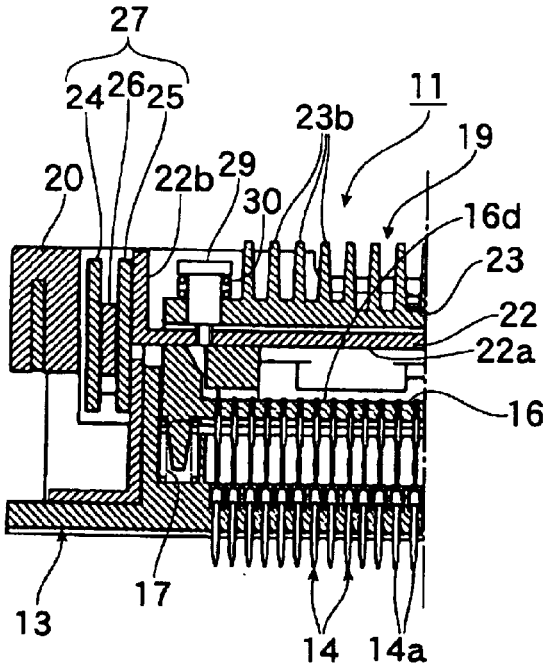
FIG. 7 is a sectional view taken along the line VII—VII of FIG. 1.

In the maximally opened state of the open/close member 19, as shown in FIGS. 5 and 6, the open/close member 19 is positioned so as to extend along substantially perpendicular direction and retired from the insertion range of the IC package 12.

Under such state, the IC package 12 is guided on the floating plate 16 under the guidance of the respective guide portions 16*b* and rested on the mount projections 16*c*. When mounted, the projecting amount (length) H2 of the mount projection 16*c* is larger than the projecting amount (length) H1 of the contact portion 14*c*, so that the terminal 12*b* of the IC package 12 does not collide with the contact portion 14*c* of the contact pin 14, and hence, both are not damaged.

Furthermore, since the contact portion 14*c* of the contact pin 14 always projects upward over the through hole 16*a* of the floating plate 16, no dust or like invades into the through hole 16*a*, thus preventing the defective contact between the IC package terminal 12*b* and the contact portion 14*c* of the contact pin 14, and the relative movement of the contact pin 14 with respect to the through hole 16*a*of the floating plate 16 can be smoothly made.

In the next stage, when the depressing force to the operation member 20 is released, the operation member is moved upward by the urging force of the coil spring 41, and accordingly, the open/close member 19 is closed in the manner reverse to that mentioned above and the abutting portion 23*a* of the heat sink 23 abuts against the die 12*c* of the IC package 12.

In this operation, the base plate 22 is slightly rotated, i.e., pivoted, about the mount shaft 33. Further, since the heat sink 23 is disposed to be vertically movable, with respect to the base plate 22, by means of mounting screws 29 and the coil spring 30, the package body 12*a* of the IC package 12 can be finely angularly adjusted by the abutment of the abutting projection 23*a* of the heat sink 23 at the time of depressing the package body 12*a* of the IC package 12. Thus, the force can be uniformly distributed under good balanced state.

Moreover, by lowering the floating plate 16 against the urging force of the spring 17, the contact portion 14*c* of the contact pin 14 largely projects over the through hole 16*a* of the floating plate 16 and the contact portion 14*c* abuts against the terminal 12*b* of the IC package 12 as shown in FIG. 9. Under such abutting state, the elastic portion 14*b* of the contact pin 14 is elastically deformed, and according to this elastic force, a predetermined abutting force or pressure can be ensured. At this moment, as shown in FIG. 8, the contact portion side of the front side of the contact pin 14 and the lead portion 14*a* of the root side thereof are positioned with a shifting of half pitch P, so that in the case where the front end of the contact portion 14*c* is depressed downward, this front end does not fall and is displaced to directly downward position, thus achieving the smooth displacement motion.

Furthermore, the location of the respective link members 24, 25 and 26 makes it possible to ensure the contacting pressure of the contact portion 14*c* of the contact pin 14 to the terminal 12*b* of the IC package 12 without using a twist coil spring having a large urging force.

That is, as shown in FIG. 3, when a force F1 is applied to the heat sink 23 towards the upward direction by the contact pin 14 and the floating plate 16, this force F1 acts on the coupling shaft 34 through the mount shaft 33. Then, a component force F2 of this force F1 acts as a force to rotate the first link outside and inside members 24 and 25 about the support shaft 32. However, in a case that it is attempted to rotate the first link outside and inside members 24 and 25 in the direction of the component force F2 from the state shown in FIG. 3, the second link 26 will act as strut member and, hence, another force F3 for directing outward the power point shaft 36 is applied.

Further, although this force F3 along the horizontal direction acts for outwardly deforming the operation member 20, it does not act for lowering the operation member. Accordingly, since the second link 26 acts as strut member without being rotated, the proper contacting pressure or force can be ensured between the terminal 12*b* of the IC package 12 and the contact portion 14*c* of the contact pin 14.

Namely, the location of the link members 24, 25 and 26 makes it possible to reduce the pressing force to the operation member 20 at the time of opening the open/close member 19, and in addition thereto, the contacting pressure between the IC package terminal 12*b* and the contact portion 14*c* of the contact pin 14 can be ensured even in the closing state of the open/close member 19.

Furthermore, the second link 26 is composed of side plate portions 26*a* which are connected through a central bridging portion 26*b*, and accordingly, even if a one-side pressing is applied to the operation member 20, the laterally paired first link outside and inside members 24 and 25 are moved integrally, and the degree of the inclination of the base plate 22 due to such one-side pressing can be largely reduced.

Still furthermore, as shown in FIG. 3, the guide pins 38 can be made shorter, so that the upper end flanged portions 38*b* of the guide pins 38 do not interfere with the heat sink 23 and other members and the IC socket 12 can be hence made compact, as shown in FIG. 5, in the state that the operation member 20 is lowered and the open/close members 19 are rotated by about 90 degrees in its perpendicular state.

Still furthermore, the coil spring 41 disposed around the thus shortly formed guide pin 38 is set to be long, so that the vertical stroke of the operation member 20 can be made longer, and according to the location of such coil spring 41, upward urging force can be ensured in this long vertical stroke.

In addition, in a case of carrying out a burn-in test by setting an IC package 12 to such IC socket 11, it is necessary to carry out the test under a predetermined temperature. However, in the accommodated condition of the IC package 12, the periphery of the IC package 12 is covered by the frame shaped operation member 20. Accordingly, even in a case that the heat is radiated through the heat sink 23, in a conventional structure, heat inside the operation member 20 is difficult to be radiated, and hence, the inside portion is increased in temperature than the outside of the IC package 12.

According to the present invention, on the other hand, since the two ventilation passages 20*f* are formed to the side portions of the operation member 20, the air circulates between the inside and outside portions of the operation member 20 through these ventilation passages 20*f*. Thus, it becomes possible to examine the IC package 12 with a predetermined temperature condition.

Moreover, these ventilation passages 20*f* are linearly formed to the opposed side portions 20*j* thereof, and accordingly, the air introduced inside the operation member 20 through the left side ventilation passage 20*f*, for example, is subjected to heat exchanging operation at the IC package accommodated portion and then exhausted outside the IC socket 11 through the right side ventilation passage 20*f*. Accordingly, such good ventilation permits effective heat radiation of the IC package 12.

Further, it is to be noted that, in the described embodiment, although the present invention is applied to an IC socket as "socket for electrical parts", the present invention is not limited to such socket and is applicable to other devices or like. Furthermore, in the embodiment, the present invention is applied to the IC socket for accommodating an LGA type device as "electrical part", but the present invention is not limited to such type and is applicable to a BGA (Ball Grid Array) type, a PGA (Pin Grid Array) type, or like in which the electrical part is depressed by utilizing an open/close member.

What is claimed is:

1. A socket for an electrical part comprising:

a socket body having an electrical part accommodation portion;

a contact pin provided for the socket body so as to be contacted to or separated from a terminal of the electrical part;

an open/close member provided for the socket body for pressing the electrical part accommodated on the accommodation portion of the socket body; and an operation member disposed for the socket body to be vertically movable so as to open or close the open/close member, said open/close member including a pressing member for pressing the electrical part and a link mechanism for supporting the pressing member to be openable, said link mechanism comprising a first link having a first and a second end sides and a second link having a first and a second end sides, the first end side of the first link being linked to be rotatable to the socket body and the first end side of the second link being linked to be rotatable to the operation member, the first and second links being linked to each other at their second end sides by a linking portion to be rotatable to each other, and a portion of the first link near to the linking portion being linked to be rotatable to the pressing member, wherein when said operation member is moved downward, the first end side of the second link is lowered to be rotated, the first link is rotated around the socket body side through the second link in the same rotational direction of the second link to displace the pressing member from a pressing position at which the electrical part is pressed to a retired position at which the electrical part is attached to or detached from the electrical part accommodation portion, and when said operation member is moved upward, the first end side of the second link is moved upwards to be rotated, the first link is rotated around the socket body side in the same rotational direction of the second link to displace the pressing member to the pressing position from the retired position.

2. The socket for an electrical part according to claim 1, wherein said first link includes a first link outside member and a first link inside member, which are arranged in parallel with a predetermined interval.

3. The socket for an electrical part according to claim 1, wherein said second link comprises a pair of side plates disposed to both sides of the pressing member and a coupling bridge portion coupling said side plates.

4. The socket for an electrical part according to claim 1, wherein said pressing member comprises a heat sink carrying out heat radiation through abutment against the electrical part.

5. The socket for an electrical part according to claim 1, wherein said socket body comprises a base portion to which a number of contact pins to be contacted to terminals of the electrical part are arranged and a floating plate disposed above the plate to be vertically movable with respect thereto, said floating plate having said electrical part accommodation portion.

6. The socket for an electrical part according to claim 1, wherein said operation member has side portions to which ventilation passages are formed respectively so as to achieve air ventilation inside and outside thereof.

7. A socket for an electrical part comprising:

a socket body having an electrical part accommodation portion;

a contact pin provided for the socket body so as to be contacted to or separated from a terminal of the electrical part;

an open/close member provided for the socket body for pressing the electrical part accommodated on the accommodation portion of the socket body; and an operation member disposed for the socket body to be vertically movable so as to open or close the open/close member, said open/close member including a pressing member for pressing the electrical part and a link mechanism for supporting the pressing member to be openable, said link mechanism comprising a first link disposed to be rotatable to the pressing member and the socket body and a second link disposed to be rotatable to the first link and the operation member, wherein when said operation member is moved downward, one end side of the second link is lowered to rotate the first link about the socket body side through the second link and thereby to displace the pressing member from a pressing position at which the electrical part is pressed to a retired position at which the electrical part is attached to or detached from the electrical part accommodation portion, and when said operation member is moved upward, one end side of the second link is moved upwards to rotate the first link about and thereby to displace the pressing member to the pressing position from the retired position, wherein said operation member has side portions to which ventilation passages are formed respectively so as to achieve air ventilation inside and outside thereof.

8. The socket for an electrical part according to claim 7, wherein said first link includes a first link outside member and a first link inside member, which are arranged in parallel with a predetermined interval.

9. The socket for an electrical part according to claim 7, wherein said second link comprises a pair of side plates disposed to both sides of the pressing member and a coupling bridge portion coupling said side plates.

10. The socket for an electrical part according to claim 7, wherein said pressing member comprises a heat sink carrying out heat radiation through abutment against the electrical part.

11. The socket for an electrical part according to claim 7, wherein said socket body comprises a base portion to which a number of contact pins to be contacted to terminals of the electrical part are arranged and a floating plate disposed above the plate to be vertically movable with respect thereto, said floating plate having said electrical part accommodation portion.

* * * * *